United States Patent [19]

Miner

[11] 4,334,788

[45] Jun. 15, 1982

[54] PIN ACTION MIXING PUMP

[76] Inventor: Robert M. Miner, 1855 Gendale, Casper, Wyo. 82601

[21] Appl. No.: 169,138

[22] Filed: Jul. 15, 1980

[51] Int. Cl.[3] ..... B01F 7/18

[52] U.S. Cl. ..... 366/303

[58] Field of Search ..... 366/302, 303, 307

[56] References Cited

U.S. PATENT DOCUMENTS

| | | | |
|---|---|---|---|
| 621,203 | 3/1899 | Ballbach | 366/303 X |
| 1,520,375 | 12/1924 | Trust et al. | 366/302 |
| 2,213,056 | 8/1940 | Skoog et al. | 366/303 X |
| 2,639,901 | 5/1953 | Teale | 366/303 X |
| 3,482,822 | 12/1969 | Krizak et al. | 366/303 X |
| 3,938,783 | 2/1976 | Porter | 366/307 X |

FOREIGN PATENT DOCUMENTS

| | | | |
|---|---|---|---|
| 2357212 | 5/1975 | Fed. Rep. of Germany | 366/303 |

*Primary Examiner*—Philip R. Coe
*Attorney, Agent, or Firm*—Laurence R. Brown

[57] ABSTRACT

A mixer-pump has a rotor shaft with a set of pins intermeshing in pins extending inwardly from a cylindrical stator to mix together materials flowing axially through the cylinder. The pins are generally cylindrical in shape except for a set of pins on the rotor shaft designated pumping pins which ae half cylindrical with their flat faces oriented to impart a longitudinal direction of travel of materials through the cylinder. Flow throughput is still further enhanced by a set of axially positioned vanes extending from the housing inwardly toward the rotor shaft with curved ends forming a scoop to receive materials being given a rotary flow component about the shaft by its rotation and convert the flow direction to an axial flow path.

2 Claims, 1 Drawing Figure

PIN ACTION MIXING PUMP

TECHNICAL FIELD

This invention relates to mixers for intermixing liquids and powders or the like, and more particularly to a structure combining the features of a mixer and a pump for passing materials through the mixer.

Background Art

Pin type mixers are well known. U.S. Pat. No. 621,203-Mar. 14, 1899 to L. Ballbach shows such an attachment on a meat cutting machine having intermeshed rotor and stator pins for mixing hamburger and the like. As in the usual meat cutter a separate spiral type feed means is used to push the materials through the mixer part.

Mixer-beater devices of the closed housing type are also well known as set forth in U.S. Pat. No. 1,520,375-Dec. 23, 1924 to H. Trust et al. This patent shows curved blades which produce internal flow patterns of the generally fluid materials being mixed.

Another type of pin mixer is shown in U.S. Pat. No. 2,639,901—May 26, 1953 to R. R. Teale which rotates one of two face to face circular discs which have extended intermeshing pin structure. Cylindrical type pin mixers are represented by U.S. Pat. Nos. 2,213,056—Aug. 27, 1940 to R. W. Skoog et al. and 3,482,822—Dec. 9, 1969 to E. J. Krizak et al.

The latter patent sets forth a problem with pin mixers not really solved therein, namely the matter of moving materials in, through, and out of the mixer or beater pins at a controlled rate to prevent overmixing, frothing, etc.

Thus, even though the art is well established there are problems in using the prior art equipment particularly when it is desired to efficiently process a large throughput of materials.

Particular problems are imposed in this respect where various muds are mixed for use in oil wells when the viscosity ranges are great such as when using bentonite to obtain mud viscosities in the range of 30 to 300. Thorough mixing is essential as well as throughput of large quantities of the mixed mud. None of the prior art pin mixers have been found satisfactory for this purpose.

Accordingly, it is an objective of this invention to improve the state of the art by supplying a novel pin mixer system that resolves problems of throughput at various viscosities and otherwise corrects defects of the prior art. Other objects, features of advantage, and operational details are to be found hereinafter throughout the description, drawing and claims.

DISCLOSURE OF THE INVENTION

There is afforded by this invention a cylindrical type pin mixer with some of the pins shaped as pumping elements and special vane structure to scoop up and deliver the materials being mixed.

Thus pins are placed to extend inwardly from a cylindrical housing and outwardly from a coaxial rotor shaft in intermeshing fashion with the pins generally cylindrical in shape and with selected pins used as pumping pins in half cylindrical shape.

Special vanes reach into a vortex of mixed materials and scoop out and redirect the material flow linearly in the direction of the rotor axis to assure proper removal and throughput at a high flow rate.

BRIEF DESCRIPTION OF THE DRAWING

The single FIGURE of the drawing shows partially cutaway the internal construction of a cylindrical pin type mixing pump afforded by this invention.

PREFERRED EMBODIMENT OF THE INVENTION

Figure 1:
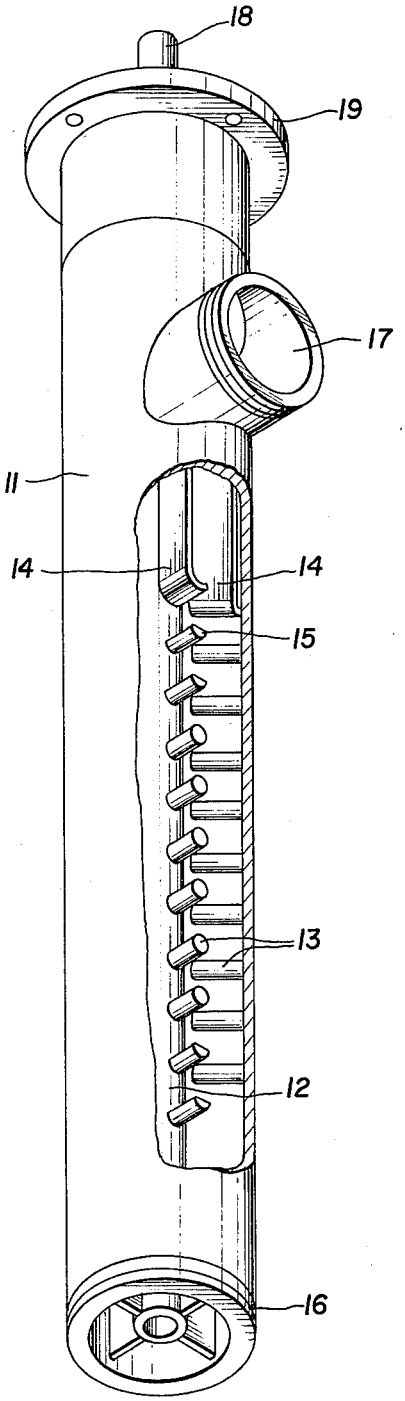

The pin mixer-pump embodiment set forth shows a generally cylindrical housing 11 with an internal rotor 12 extending from shaft 18 which is driven by a motor at 1725 revolutions per minute. A bearing assembly about the shaft 18 is provided at the inlet end 16 of the pump and at the flange mount end 19. Thus, a flow of materials, generally a mixture of powdered and liquid materials is entered at the inlet end 16 and is mixed by intermeshing of pins 13 relatively located on the rotor 12 and stator 11 and passed out the generally perpendicular outlet pipe 17. Other inlet or outlet pipes can be afforded for the generally axial flow of materials along the rotor shaft 12 toward the mounting flange 19.

All the pins 13 on the stator housing are generally cylindrical in shape and serve as mixing pins. However, upper and lower sets of half cylindrical pins 15 on the rotor shaft serve as pumping pins. They are thus located with faces at an angle providing an axial motion to the materials toward outlet 17.

In this embodiment the shaft rotates counterclockwise and thus tends to create a vortex or rotary path of materials concentric about the shaft. The flat faces of semicircular pins 15 will then urge the materials through the mixing pins at a proper rate for intimately mixing without unnecessary frothing or beating.

Near the upper portion of the shaft and disposed about the shaft are directing vanes 14 in a set which transfers the generally circular concentric pattern of flow caused by rotating shaft 12 and the pins thereon into a longitudinal flow to reach and pass out outlet 17. These vanes are fastened to the interior of the stator housing and have a curved lowermost scoop portion which receives the rotationally directed materials and converts the direction of travel to a linear axial path along the rotor 12.

With this improved construction, a homogeneous mass may be obtained from liquid and powder for example with minimum power and with large volume throughput. It is particularly adept at mixing bentonite into a mud slurry for use in oil wells at any desired viscosity in the range from 30 to 300.

Typical dimensions for this purpose are as follows:

rate of flow—150 gallons per minute at a pressure head of ten feet.

stator housing—four inches (10.16 cm) inner diameter.

rotor shaft—$1\frac{3}{4}$ inches (4.44 cm) diameter.

mixing pins—$\frac{1}{4}$ inch (63 mm) diameter.

pumping pins—$\frac{3}{8}$ inch (95 mm) half round diameter.

Other materials such as polymers, starches, salt, etc. can be put into solution or slurry in a similar manner. Preferably the parts are stainless steel for long corrosion free wear.

Industrial Application

A high volume 150 gallon per minute mixing pump for use in making mud slurries of variable viscosity for oil well use or other solutions or slurries or powders and liquids.

I claim:

1. A pin action mixing pump for thorough mixing of materials without significant frothing comprising in combination, a rotor having extending therefrom a set of substantially cylindrical pins, a stator having extending therefrom in positions meshing with the rotor pins a set of substantially cylindrical pins so that the rotor carried pins pass through the stator carried pins, thereby establishing a set of mixer pins, a fluid transmission passageway extending between said rotor and stator pins, and sets of semi-cylindrically shaped pins located on each end of said rotor to comprise pumping pins for engaging fluid in said passageway to move it along said passageway in response to rotation of said rotor with the flat surfaces of said semi-cylindrically shaped pins disposed at an angle urging the materials through the mixing pins at a proper rate for intimately mixing without unnecessary frothing.

2. A pin action mixing pump comprising in combination, a rotor having extending therefrom a set of pins, a stator having extending therefrom in positions meshing with the rotor pins a set of pins so that the rotor carried pins pass through the stator carried pins, thereby establishing a set of mixer pins, a fluid transmission passageway extending between said rotor and stator pins, and means shaping selected ones of said rotor pins to comprise pumping pins for engaging fluid in said passageway to move it along said passageway in response to rotation of said rotor, said rotor having a rotor shaft turning in a specified direction wherein the pins are mounted over a fixed span along a portion of the shaft, an inlet for materials to be mixed for passing them along and about said shaft past the pins, directing vane means with longitudinal members located substantially parallel to said shaft about the shaft at the end of said span and terminating in a scoop adjacent the pins at the end of the span, said scoop being curved to receive materials rotated by the pins thereinto and changing the direction of travel to a linear path parallel with the axis of the rotor shaft, and an outlet removing from the stator the materials flowing parallel to the shaft by action of the directing vanes.

* * * * *